United States Patent [19]

Crumbliss

[11] 4,353,317

[45] Oct. 12, 1982

[54] METHOD AND APPARATUS FOR TUFTING HIGH AND LOW PILE IN THE SAME ROW OF STITCHING

[75] Inventor: Robert T. Crumbliss, Chattanooga, Tenn.

[73] Assignee: Spencer Wright Industries, Inc., Chattanooga, Tenn.

[21] Appl. No.: 345,929

[22] Filed: Feb. 4, 1982

[51] Int. Cl.[3] ..... D05C 15/00

[52] U.S. Cl. ..... 112/266.2; 112/79 R; 112/79 A

[58] Field of Search ..... 112/79 R, 266.2, 79 A

[56] References Cited

U.S. PATENT DOCUMENTS

| | | | |
|---|---|---|---|
| D. 253,473 | 11/1979 | Jolley | 112/79 R X |
| 3,108,553 | 10/1963 | Beasley | 112/79 R |
| 4,134,347 | 1/1979 | Jolley et al. | 112/79 R |
| 4,245,574 | 1/1981 | Wilson | 112/79 R |
| 4,285,288 | 8/1981 | Inman et al. | 112/79 R |
| 4,301,751 | 11/1981 | Caylor | 112/79 R |

*Primary Examiner*—Ronald Feldbaum
*Attorney, Agent, or Firm*—Alan Ruderman

[57] ABSTRACT

A tufting machine having two bladed hooks facing oppositely to the direction of backing material feed has a gate member associated with the lower of the blades. The opening and closing of the gate members are determined by a pattern so that each needle may selectively form a high or a low level cut pile tuft. Loops are initially seized by the bill of the lower blade. Each gate member has a latch for selectively closing or opening entry of a loop from the lower bill onto the lower blade. The upper blade has a bill overhanging the lower bill and loops precluded from entry onto the lower blade are shed by the lower bill and seized by the upper bill for entry onto the upper blade. A knife acts with each blade to cut loops thereon to form cut pile at the level of the respective blade.

9 Claims, 4 Drawing Figures

METHOD AND APPARATUS FOR TUFTING HIGH AND LOW PILE IN THE SAME ROW OF STITCHING

BACKGROUND OF THE INVENTION

This invention relates to tufting machines and more particularly to a method and apparatus for tufting cut pile of different levels in the same row of stitching.

Numerous attempts have been made for selectively forming different pile heights by each needle of a cut pile tufting machine. For example, in U.S. Pat. No. 3,138,126 a hook having first and second vertically spaced blades in which the bill of the lower blade has a spring clip is illustrated. Yarn tension produced by a yarn feed control mechanism selectively moves the clip to open and close passage of a loop onto the lower blade. When the spring is pulled away from the lower bill the loop is shed and seized by the upper bill to produce a low cut pile tuft. If sufficient yarn is fed to the needle the spring clip remains in engagement with the lower bill and prevents sheding to form a high cut pile tuft. Back-drawing of the yarn by the feed mechanism effects the high tension to release the clip. In U.S. Pat. No. 3,075,482 a similar arrangement is disclosed for producing three levels of pile, a high and medium cut pile and a low loop pile.

In U.S. Pat. Nos. 3,820,482 and 4,029,029 the hooks have spaced upper and lower blades, the bills of the upper blades having a lower surface below the bills of the lower blades and shaped to allow a loop to travel toward the lower bill. Both of these patents utilize a knife for each blade and a yarn feed control mechanism for controlling whether the loops are received onto the lower bill or pulled through the space between the bills and caught by the upper blade. Consequently, in all of the known prior art proposals to produce a high and low cut pile in the same row of stitching, a yarn feed control system in which the amount of yarn being fed for each stitch and thus the tension on the yarn provides the control force which effects the height of the pile produced.

SUMMARY OF THE INVENTION

The present invention provides a method and apparatus for tufting cut pile of different heights selectively in the same row of stitching which does not use a yarn feed control mechanism. Instead the present method and apparatus provide a positive control over whether a loop of yarn is received by an upper or a lower blade of the hook. No special feed mechanism is required and no extra back-drawing of yarn beyond that conventionally performed to tighten the stitches is required. The maximum yarn requirements of the loop forming system, i.e. the amount of yarn received by the needle and hook, are determined solely by the loop forming system itself which is assured by a simple one-way yarn clamp.

In practicing the principles of the present invention a two billed hook having the bill of the upper blade extending outwardly beyond that of the bill of the lower blade is provided with a selectively moveable gate member which opens or closes a passage of a loop onto the lower blade. Initially each loop is seized by the lower bill. When the gate opens, passage of the loop onto the lower blade proceeds toward the closed end of the hook to be cut by a knife and forms a high cut pile. When the gate closes passage of the loop onto the lower blade, the loop so prevented from entry thereon is released from the bill of the lower blade and is seized by the upper bill where it moves along a contoured portion of the upper bill to the upper blade. The loop so seized by the upper blade proceeds along the blade to the closed end of the hook to be severed by a knife, such knife preferably being the same knife that acts on the lower blade.

In the preferred embodiment of the invention the gate is in the form of, and controlled in a manner similar to, the gate illustrated in U.S. Pat. No. 4,134,347 which is assigned to the same assignee as that of the present invention. Thus, the gate may be pivotably mounted on the neck of the hook and pivotably actuated by means controlled by signals from a pattern control.

Consequently, it is a primary object of the present invention to provide a reliable method and apparatus for forming tufted fabrics having a selective array of high and low cut pile in each row of stitching.

In is another object of the present invention to provide a tufting machine and method for selectively forming high and low pile without the utilization of a yarn feed control device.

It is a further object of this invention to provide in a tufting machine a hook having a pair of vertically spaced blades, the bill of the lower blade having a gate member associated therewith which can selectively close the lower bill from the blade to prevent seized loops from moving onto the lower blade, such loops being shed by the lower bill and seized by the upper bill for entry onto the upper blade.

It is a still further object of the present invention to provide in a tufting machine a two bladed hook, the blades being spaced apart in a direction relative to the backing material and the bill of the lower blade having a gate associated therewith for opening and closing entry to the blade of a loop seized by the lower bill, the gate being controlled by a pattern, and knife means accociated with each blade so that loops entering the lower blade are severed to form high cut pile and loops precluded from entry onto the lower blade are shed by the lower bill and seized by the upper bill for entry onto the upper blade and cut thereon to form low cut pile.

It is yet a further object of the present invention to provide a hook for a tufting machine having a pair of spaced blades and a gate member pivotably supported on the hook for selectively closing the rear of the lower bill from the lower blade and for opening the lower bill to the lower blade.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
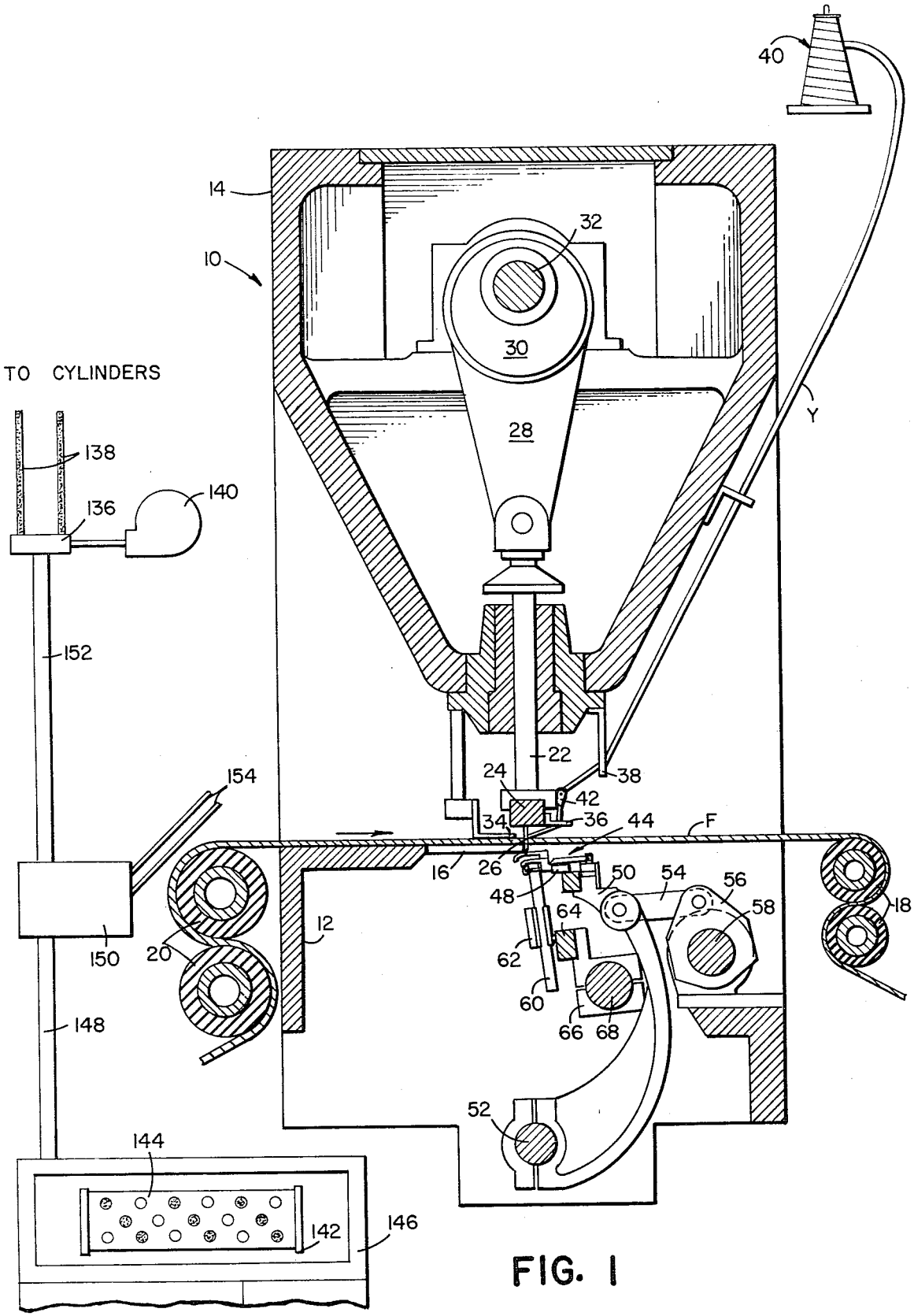
FIG. 1 is a vertical sectional view taken transversly through a multiple needle tufting machine embodying apparatus constructed in accordance with the principles of the present invention and illustrating certain aspects in diagrammatic form.

Referring now to the drawings, there is illustrated in FIG. 1 a tufting machine 10 having a frame comprising a bed 12 and a head 14 disposed above the bed. The bed 12 includes a needleplate having a plurality of spaced fingers 16 across which a fabric F is adapted to be fed by a pair of feed rollers 18 and take-off rollers 20.

Mounted in the head for vertical reciprocation is one of a plurality of push rods 22, to the lower end of which a needle bar 24 is carried and which in turn carries a plurality of needles 26 that are adapted to penetrate the fabric F through the fingers 16 upon reciprocation of the needle bar 24 to project loops of yarn Y therethrough. Endwise reciprocation is imparted to the push rods 22 and thus the needle bar 24 and needles 26 by a link 28 which is pivotably connected at its lower end to the push rods and at its upper end to an eccentric 30 on a driven rotary main shaft 32 that is journalled longitudinally in the head 14. A presser foot assembly 34 may be supported on the head to hold down the fabric F during needle retraction. A yarn-jerker 36 is carried by the needle bar 24 and operates to engage yarn between a stationary yarn guide 38 on the frame of the machine and the needles 26.

Yarn Y is supplied to each needle 26 from a yarn creel indicated generally at 40, which unlike that required by the aforesaid patented constructions, need not be a yarn feed control nor even simple yarn feed rollers. Instead, a yarn clamp 42 is mounted on the needle bar 24 for permitting yarn to be pulled by the respective needle from the yarn creel 40 only while the needle is descending which precludes the drawing of excess yarn beyond the maximum amount required to form a loop. Thus, the yarn clamp 42 is a one-way or ratchet clamp such as is conventional in skip-stitch tufting machines.

Mounted within the bed for cooperation with the respective needle to seize loops of yarn presented thereby is a respective hook generally illustrated at 44 having spaced bills which point in the direction opposite to that in which the fabric is fed and to which further reference will be made. The hooks have mounting portions or shanks 46 that are mounted in hook bars 48 carried by a mounting bar 49 secured to the upper end of a rocker arm 50. Any conventional means to oscillate the arm 50 may be provided. In the preferred embodiment the lower end of the rocker arm 50 is clamped to a laterally extending rock shaft 52 journaled in the bed. Pivotably connected to the upper portion of the rocker arm 50 is one end of a connecting link 54 having its other end pivotably connection between forked arms of a jack shaft rocker arm 56. The arm 56 is clamped to a jack shaft 58 which has oscillating motion imparted thereto by conventional drive means such as a cam and lever arrangement (not illustrated) driven from the main shaft 32 in timed relationship with the reciprocation of needles. The tufting machine incorporates a plurality of knives 60 which cooperate with the hooks to cut the loops to form cut pile as hereinafter described. Preferably there is one knife for each hook, but a separate knife may be utilized for each blade of the hook without departing from the spirit of the invention. The knives may be mounted in knife blocks 62 secured to a knife bar 64 which in turn is secured to a knife shaft rocker arm 66 clamped to a knife shaft 68. Oscillatory motion is imparted to the knife shaft 68 to conventionally drive the knives into cutting engagement with one side of the respective hooks to provide a scissors-like cutting action to form cut pile tufts.

Figure 2:
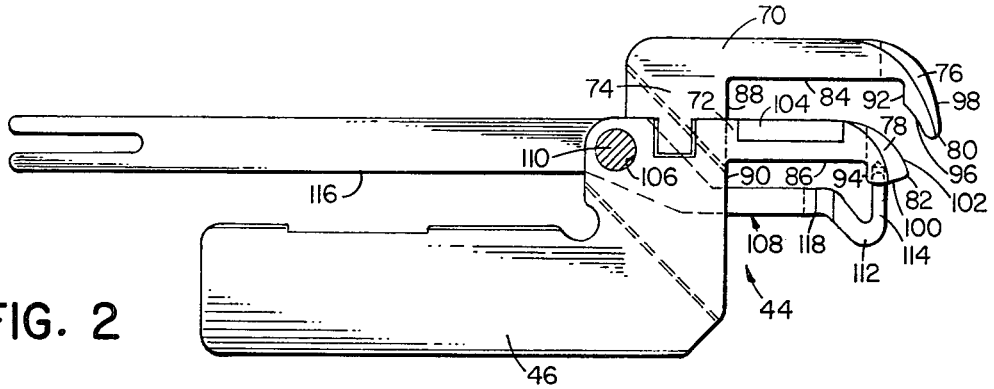
FIG. 2 is an elevational view greatly enlarged of the preferred form of the hook illustrated in FIG. 1.

Referring now to FIG. 2 each hook 44 comprises two blades 70, 72 extending from a neck 74, the blade 70 being disposed above the blade 72 and closer to the backing material F when assembled in the tufting machine. Each blade has a respective bill 76, 78 at the free end thereof. Each bill extends downwardly along its respective upper edge toward a respective beak 80, 82 at the free end, the beak 80 extending forwardly beyond the beak 82. The blades 70, 72 have respective bottom edges 84, 86 which join the neck 74 at the respective throats 88, 90 at the closed end of the hook and at the free end join the bills 76, 78 at respective downwardly depending edges 92, 94. From the lower end of the edge 92 the bill 76 extends forwardly along an arcuate edge 96 toward the beak 80 which is rounded and flows into an arcuate upper surface 98 of the bill. The lower end of the edge 94 of the lower shorter bill 78 smoothly flows into a bottom edge 100 of the bill 78. The edge 100 extends toward the beak which is joined to the top of the blade by an arcuate edge 102. To provide a relief against interference of the knife 60 so that a single knife can cut properly with the upper blade 70 while also cutting correctly on the lower blade, the lower blade 72 is provided with a relief surface 104 cut at the upper edge thereof and extending partly down its width, the distance along the blade and the width of the surface 104 being sufficient to allow the knife to act at the correct angle with the upper blade. The hook may be formed as a unitary stamping or the upper blade may be formed separately from the remainder of a hook and secured thereto by solder or the like. However, it is preferred that the hook be constructed with the upper bill as a separate member from the remainder of the hook and brazed to the upper blade.

A bushing (not illustrated) is positioned in a hole 106 in a gate member 108 and together they are pivotably journaled on a screw 110 threaded into the neck 74 of the hook on the side opposite to that against which the knife 60 acts, i.e. the side opposite to which the relief surface 104 is formed. The gate 108 includes a hook shaped head 112 having an outstanding projection 114 adapted to engage within a hole (not illustrated) in the bottom edge 100 of the bill 78 to define a latch adjacent to the beak 82 to prevent selected loops from passing from the bill onto the blade. The gate 108 includes a tail portion 116 at the other side of the pivot screw 110 and thus acts as a pivotable lever. The gate is bent at 118 from the plane of the face of the surface of the hook at the neck so that the head 112 is substantially intermediate the faces of the bill 78 for receipt within the hole to ensure that when the gate is closed no loop will slip by the latch.

Figure 3:
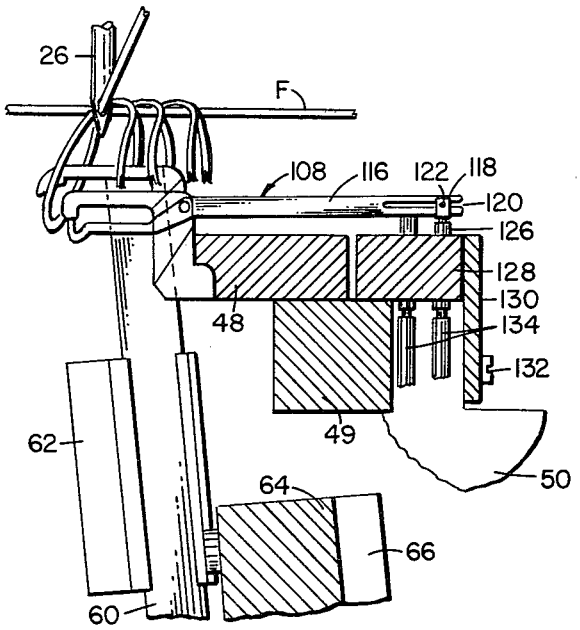
FIG. 3 is a fragmentary vertical sectional view of a portion of the tufting machine illustrated in FIG. 1, but enlarged to show the hook with the gate closed and a loop being shed from the lower bill for seizure by the upper bill; and, FIG. 4 is a view similar to FIG. 3, but showing the hook with the gate open to allow a loop seized by the lower bill to move onto the lower blade.
Figure 4:
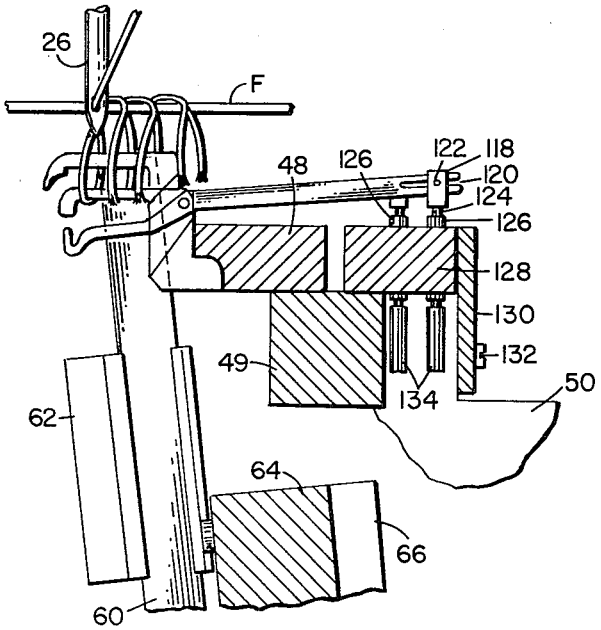

To pivotably move the gate about its pivot journal the tail portion 116 of the gate may be selectively actuated by any convenient means controlled by a pattern. In the preferred embodiment each tail 116 is received between a forked member 118 which entraps a slot 120 in the tail about a pin 122 extending between the tines of the member 118 for swinging movement. The fork members 118 are secured to stems 124 of pistons (not illustrated) of respective pneumatic cylinders 126 mounted in support bars 128 that may be mounted for oscillation with the hooks 44. To this end the support bars 128 may be secured to a bracket 130 that is attached by bolts 132 to the rocker arm 50 and the support bars 128 may rest on or may be secured to the upper surface of the mounting bar 49 adjacent to the hook bar 48. As illustrated in FIG. 3, the pistons of the cylinders 126 are normally biased downwardly so that normally the gates are positioned to close the bills 78 of the lower hook blade for forming low level cut pile, but the reverse situation with upwardly biased pistons may be constructed readily and the lower bills would then be opened for forming high level cut pile. Thus, as illustrated in FIG. 4 to form high level cut pile, air is admitted into inlet lines 134 to drive the pistons and forked members 118 upwardly to pivotably open the gates.

The admission and release of air from each of the cylinders 126 is effected by respective electrically controled pneumatic valves 136 having air lines 138 communicating with the valves and with a compressor 140 or other source of pressurized air. Although the pneumatic system is preferred other means such as electrical solonoids or a mechanical drive may be used in place of the cylinder, valves and compressor. The valves are electrically controlled to allow pressurized air from the compressor to enter the cylinders or to vent the air from the cylinders to atmosphere, thereby pivoting the gate.

To control the valves 136 and thereby the height of the cut pile produced by a given needle any convenient patterning device may be used, such as a magnetic tape system, a punched tape system, or a microprocessor with programmed memory, but as is conventional in the tufting industry it is preferred to use a transparent pattern drum 142 carrying a pattern sheet 144 mounted in a console 146 such as the system illustrated in the aforesaid U.S. Pat. No. 4,134,347. Photocells (not illustrated) within the console sense the light and dark areas of the pattern through the drum by mounting a source of light on one side of the drum and the photocells on the other side. The output of the photocells are transmitted to switching units within the console 146 to provide signals to wires within a conduit 148 to an amplifier 150 where these signals are amplified and transmitted by wires within conduits 152 to the individual valves 136. Electrical wires 154 connect the amplifier to synchronizing means to ensure that the signals from the pattern console 146 are timely presented to the valves 136 so that the pneumatic cylinders actuate the gates when a loop seized by the lower hook beak 82 has been shed by the bill 78 for low level cut pile or has moved past the surface 100 and is behind the edge 94 for high level cut pile. Any convenient synchronizing system such as that illustrated in the aforesaid U.S. Pat. No. 4,134,347 may be provided, such systems being well-known in the art for providing a pulse timed with the rotation of the main shaft 32.

In operation, a loop presented by a needle will be seized by the bill 78 of the lower hook blade at the surface 100 adjacent to the beak 82. Since the bills face oppositely to the direction of backing material feed the loop is moved by the backing material toward the closed end of the hook as the hook oscillates away from the loop seizing position. If the pattern on the sheet 144 has called for the stitch to be a low level tuft a signal to this effect is timely given after the previous stitch to move the valve 136 for venting air from the cylinder 126. This, since the pistons are normally biased downwardly, presents the extended portion 114 of the gate into the hole in the surface 100 of the lower bill 78 to close the path of a seized loop from proceding toward the blade 72 as illustrated in FIG. 3. A loop so prevented from moving onto the lower blade is shed by the bill of the lower blade as the hook oscillates away from the loop seizing position. A loop so shed is seized by the surface 96 of the upper bill 76 and procedes with the backing material toward the closed end, i.e. toward the throat 88 of the upper blade 70. As the loop is tightened by the action of the ascending needle, and by the formation of the next stitch, it is drawn up against the edge 84 of the blade 70 and is subsequently cut adjacent to the throat 88 by the oscillating knife 60 to form a cut pile tuft at the disposition of the surface 84 relatively to the backing material F.

If the pattern calls for a high cut pile tuft the signal transmitted to the valves 136 effects admission of pressurized air to the cylinder after the previous loop has been shed and that gate is pivoted to move the latch 114 away from the bill 78 of the lower blade. Thus, as illustrated in FIG. 4, the loop now seized by the bill 78 is permitted to move from the bill beyond the surface 94 to the blade as the fabric moves the loop toward the closed end of the hook. As the needle ascends the loop is drawn up against the edge 86 of the lower blade and gradually moves rearwardly toward the knife cutting location where it is severed by the knife 60 to form cut pile substantially at the location of the surface 86 of the lower blade so that a high cut pile tuft is formed.

It is understood that as the needle descends yarn Y is pulled by the needle past the one-way clamp 42 to draw yarn downwardly for forming a loop for initial seizure by the bill 78. As the needle ascends, the yarn jerker 36 pulls the free leg of the yarn upwardly to tighten the yarn against either the edge 84 or the edge 86 of the upper or lower blade respectively. Yarn cannot be pulled past the clamp 42 unless sufficient tension is put on the yarn to open the clamp. Since the distance between the clamp 42 and the needle eye is fixed, when a low cut pile is formed there is excess yarn between the needle eye and the clamp 42, i.e. more yarn was required to form a loop than that utilized for the stitch. Thus, during the formation of the next loop a smaller amount of yarn is pulled past the clamp 42 than in the case of the formation of a high level cup pile. Consequently, the clamp 42 allows the needle to draw as much yarn as it needs during each loop forming decent and no yarn feed mechanism is required. The clamp 42 ensures that only the maximum amount of yarn is fed from the creel 40 by the loop forming system.

It should be understood that although the disclosure only relates to one hook, a tufting machine has a multiplicity of hooks and that by incorporating the gating feature in many, if not all, of the hooks unique high and low cut patterning effects may be produced in the backing material. Moreover, it should be understood that although a single knife for each hook is disclosed, this being preferred so that finer gauge can be obtained, in courser gauge machines it may be preferred to have separate knives acting on each hook blade. This latter arrangement would result in each knife having less oscillatory movement than that require by a single knife system.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention what is claimed herein is:

1. In a tufting machine, means for feeding a base material in one direction, a yarn carrying needle disposed on one side of said base material, means for reciprocating said needle for penetrating said material and forming loops therein, means for mounting a hook having first and second blades on the opposite side of the base material from needle, each blade having a free end facing in a direction opposite to the direction of feed of the base material and a closed end, the free end of the first blade extending further than that of the second blade relatively to the needle path and each blade having a bill including a loop seizing edge at the free end, said first blade being disposed closer to said base material than said second blade, means for oscillating said hook toward and away from the path of said needle for seizing loops of yarn in succession by the loop seizing edge of the second bill, gate means for engageably cooperating with the loop seizing edge of the second bill for selectively closing and opening passage of a loop from the loop seizing edge of the second bill to the second blade, whereby selected loops are permitted entry onto the second blade and the other loops are shed by the second bill as the hook moves away from the needle and are seized by the loop seizing edge of the first bill for entry onto the first blade, control means for selectively moving said gate means into and out of engageable cooperation with said loop seizing edge of the second bill, and knife means cooperating with said first and second blade for severing respective loops thereon to form cut pile of first and second pile heights.

2. In a tufting machine as recited in claim 1, wherein said gate means comprises a lever, journal means for pivotably mounting said lever intermediate its extremities on said hook, said lever having a latch on one side of said journal means for engaging said loop seizing edge of the second bill, said control means including means acting on the lever on the other side of said journal means.

3. In a tufting machine as recited in claim 1, wherein said knife means comprises a knife and means for oscillating said knife into cooperation with each of said first and second blades.

4. In a tufting machine as recited in claim 3, wherein said second blade includes a relief for preventing interference of said knife for cutting loops on said first blade.

5. In a tufting machine as recited in claim 1, including a yarn clamp moveable with said needle, said yarn clamp having means for allowing yarn to be pulled past said clamp from a yarn source only while forming each loop.

6. A method of tufting cut pile having different pile heights in the same row of stitching comprising, supporting and feeding a backing material in one direction, stitching a yarn continuously through said backing material as the material moves to form a row of successive yarn loops on one side of said material, supporting on said one side of said material an oscillating hook having first and second free ends pointing in the direction opposite the backing material feed and having a respective first and second blade portion adjacent each free end, said second free end being below the first free end at a level for entering and seizing said loops in succession, closing said second free end with a moveable gate to prevent entry of a selected loop onto the second blade portion, sheding said selected loop from the second free end, seizing said selected loop by the first free end, moving the gate away from the second free end to permit entry of another selected loop onto the second blade portion and severing the loops on the first and second blade portions to produce cut pile.

7. A hook for use in a tufting machine, said hook being planar and comprising a body portion having first and second blades and a shank having a mounting portion for mounting in a tufting machine, said first and second blades extending from said shank to define respective first and second throats therebetween, each blade including a bill extending from the respective blade remote from said shank and terminating in respective free ends, a gate member having a free end defining a latch, and means for pivotably mounting said gate on said shank for movement of said latch into and out of engagement with the free end of said second bill.

8. In a hook as recited in claim 7, wherein each blade has a top edge, and a bottom edge that extends from said throat to the respective bill, and said bottom edge of each blade adjacent to said throat is formed to cooperate with knife means to sever loops of yarn against each lower edge.

9. In a hook as recited in claim 8, wherein said second blade has a relief portion at the top edge for allowing a single knife to cooperate with both blades.

* * * * *